US005814775A

United States Patent [19]

Chou

[11] Patent Number: 5,814,775

[45] Date of Patent: Sep. 29, 1998

[54] ROTARY SWITCH WITH NON-DEFORMABLE CONNECTING END PORTIONS

[75] Inventor: Tien-Ming Chou, Taichung, Taiwan

[73] Assignee: Excel Cell Electronic Co., Ltd., Taichung, Taiwan

[21] Appl. No.: 708,932

[22] Filed: Sep. 6, 1996

[51] Int. Cl.[6] ..... H01H 19/60; H01H 9/00

[52] U.S. Cl. ..... 200/11 R; 200/11 A; 200/14; 200/11 D; 200/527

[58] Field of Search ..... 200/11 R, 11 D, 200/11 DA, 11 A, 14, 292, 294, 307, 17 C, 17 L, 302, 400, 417, 527; 361/400, 408; 439/712, 715

[56] References Cited

U.S. PATENT DOCUMENTS

| | | | |
|---|---|---|---|
| 3,668,338 | 6/1972 | O'Malley | 200/11 A |
| 4,260,860 | 4/1981 | Niihama et al. | 200/6 R |
| 4,346,269 | 8/1982 | Slavin et al. | 200/11 DA |
| 4,400,597 | 8/1983 | Bruder et al. | 200/6 B |

*Primary Examiner*—Peter S. Wong

*Assistant Examiner*—Rajnikant B. Patel

*Attorney, Agent, or Firm*—Darby & Darby

[57] ABSTRACT

A rotary switch includes an insulative first housing with first and second terminals, and an insulative second housing. The first housing has a top wall with an axial hole formed therein, a bottom wall with a socket-like cavity formed therein, an upright side wall lateral to the top wall, and a shaft journalled in the axial hole to rotate stepwise relative to the top wall. The first terminals have first connecting end portions extending outwardly of the upright side wall. The second terminals have second connecting end portions extending axially from the axial hole and outwardly of the bottom wall at a distal end thereof relative to the upright side wall. The second connecting end portions are longer than the first connecting end portion so that each of the second connecting end portion forms a protracted intermediate segment and a connecting end segment for electrical connection. The second housing is molded around portions of the protracted intermediate segments of the second terminals. When bent over the bottom wall, the second housing is press-fitted in the socket-like cavity of the first housing, thereby disposing the connecting end segments to extend beyond the upright side wall and parallel to the first connecting end portions.

4 Claims, 3 Drawing Sheets

ROTARY SWITCH WITH NON-DEFORMABLE CONNECTING END PORTIONS

BACKGROUND OF THE INVENTION

1. Field of the Invention

The invention relates to a rotary switch, more particularly to a rotary switch with connecting end portions which are used for electrical connection and which do not deform easily.

2. Description of the Related Art

Referring to FIG. 1, a first conventional rotary switch is shown to include an insulative first housing 1, an insulative second housing 2 attached to the first housing 1, a shaft 1A journalled in an axial hole 1B of the first housing 1 so as to rotate stepwise relative to a top wall 1C of the first housing 1, and first and second terminal units 30, 31. The first terminal unit 30 includes three first contact end portions (not visible) embedded in the first housing 1, and three first connecting end portions 301 which extend traversely from the axial hole 1B and outwardly of the upright side wall 1D. Each of the first connecting end portions 301 has a first length sufficient for external electrical connection. The second terminal unit 31 includes three second contact end portions (not visible) embedded in the first housing 1, and three second connecting end portions 311 which extend axially from the axial hole 1B and outwardly of the second housing 2 at a distal end thereof relative to the upright side wall 1D for external electrical connection. Stepwise rotation of the shaft 1D relative to the top wall 1C of the first housing 1 actuates a switching action among the first and second contact end portions.

Each of the second connecting end portions 311 in the second terminal unit 31 has a second length longer than the first length of the first connecting end portion 301 in the first terminal unit 30 and is exposed outwardly from the second housing 2. Thus, the second connecting end portions 311 may collide with other elements during mounting of the rotary switch, thereby causing deformation of the second connecting end portions 311 and correspondingly resulting in poor electrical connection.

Referring to FIG. 2, a second conventional rotary switch is shown to be similar to the first conventional rotary switch in construction except that the second housing 7 defines three parallel retaining grooves 70 therein. When attached to the first housing 4, the second connecting end portions 611 of the second terminal unit 61 are retained in the grooves 70 of the second housing 7, thereby disposing the second connecting end portions 611 parallel to the first connecting end portions 601 of the first terminal unit 60. Under this condition, the second connecting end portions 611 are prevented from deformation and correspondingly provide good electrical connection.

A drawback of the second conventional rotary switch resides in that two mold units must be used in order to manufacture the first and second housings 4, 7, thus resulting in extra expense.

SUMMARY OF THE INVENTION

The object of this invention is to provide a rotary switch which can be manufactured at a relatively low cost and which has terminal connecting end portions for electrical connection that are not easily deformed.

Accordingly, the rotary switch of this invention includes an insulative first housing with a plurality of first and second terminals for electrical connection, and an insulative second housing. The first housing has a top wall with an axial hole formed therein, a bottom wall with a socket-like cavity formed therein, an upright side wall lateral to the top wall, and a shaft journalled in the axial hole to rotate stepwise relative to the top wall. The first terminals are disposed in a first array and have first contact end portions embedded in the first housing, and first connecting end portions which extend traversely from the axial hole and outwardly of the upright side wall. The first connecting end portions of the first terminals respectively have a first length sufficient for external electrical connection. The second terminals are disposed in a second array and have second contact end portions embedded in the first housing, and second connecting end portions which extend axially from the axial hole and outwardly of the bottom wall at a distal end thereof relative to the upright side wall. Each of the second connecting end portions has a second length longer than the first length of the first connecting end portions so as to form a protracted intermediate segment and a connecting end segment for electrical connection. The second housing is molded around portions of the protracted intermediate segments of the second terminals, and is formed like a plug-like body such that, when the second connecting end portions of the second terminals are bent over the bottom wall of the first housing, the plug-like body is press-fitted in the socket-like cavity of the first housing, thereby disposing the connecting end segments to extend beyond the upright side wall of the first housing and parallel to the first connecting end portions.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENT

Figure 1:
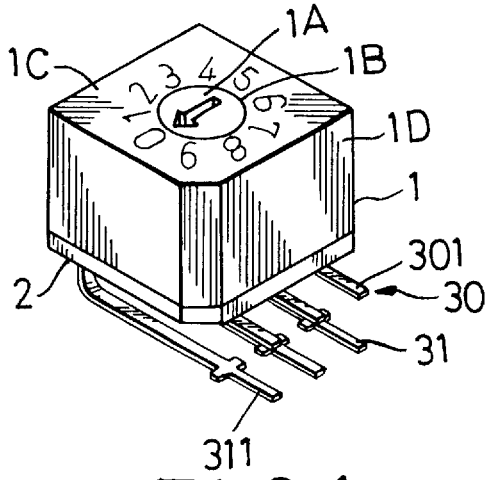
FIG.1 PRIOR ART
FIG. 1 is a perspective view of a first conventional rotary switch.
Figure 2:
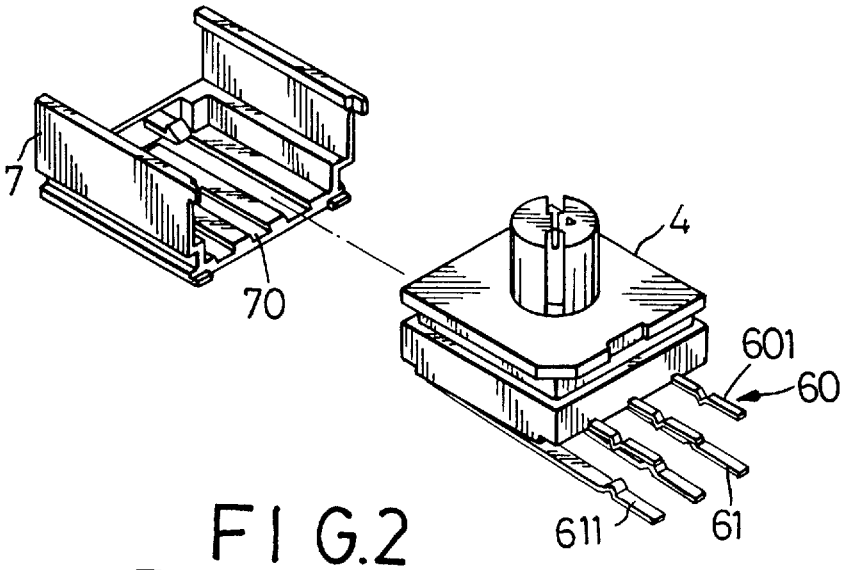
FIG.2 PRIOR ART
FIG. 2 is an exploded view of a second conventional rotary switch.
Figure 3:
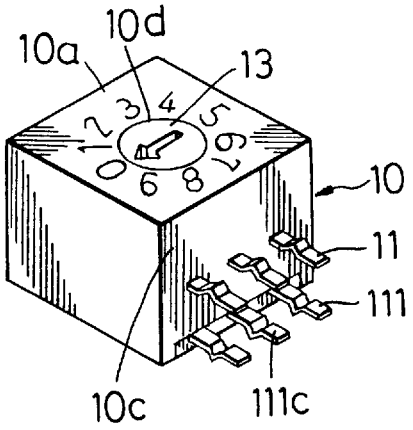
FIG. 3 is a perspective view of a rotary switch of this invention.
Figure 4:
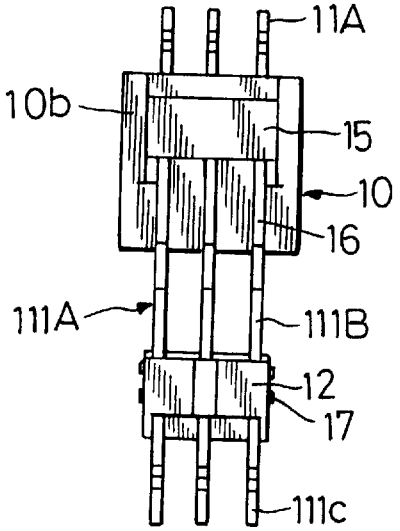
FIG. 4 is an exploded bottom view of a rotary switch of this invention.

Referring to FIGS. 3 and 4, the preferred embodiment of a rotary switch of this invention is shown to include an insulative first housing 10 with first and second terminal units 11, 111, and an insulative second housing 12 which is formed like a plug-like body for insertion into the first housing 10.

As illustrated, the insulative first housing 10 has a top wall 10*a* with an axial hole 10*d* formed therein, a bottom wall 10*b*, an upright side wall 10*c* lateral to the top wall 10*a*, and a shaft 13 journalled in the axial hole 10*d* to rotate stepwise relative to the top wall 10*a*. The bottom wall 10*b* has a socket-like cavity 15 and three retaining grooves 16 in communication with the cavity 15.

The first terminal unit 11 includes three terminals which are disposed in a first array. Each of the terminals of the first terminal unit 11 has a first contact end portion (not visible) embedded in the first housing 10, and a first connecting end portion 11A which extends traversely from the axial hole 10*d* and outwardly of the upright side wall 10*c* and which has a first length that is sufficient for external electrical connection.

The second terminal unit 111 includes three terminals which are disposed in a second array. Each of the terminals of the second terminal unit 111 has a second contact end portion (not visible) embedded in the first housing 10, and a second connecting end portion 111A that extends axially from the axial hole 10*d* and outwardly of the bottom wall 10*b* at a distal end thereof relative to the upright side wall 10*c*. The second connecting end portion 111A has a second length longer than the first length so as to form a protracted intermediate segment 111B and a connecting end segment 111C for external electrical connection.

Figure 5:
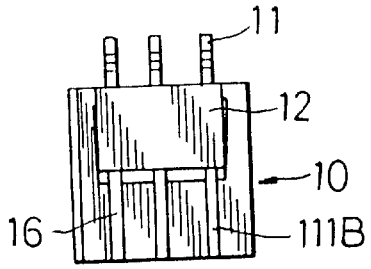
FIG. 5 is a bottom view of the rotary switch of this invention.
Figure 6:
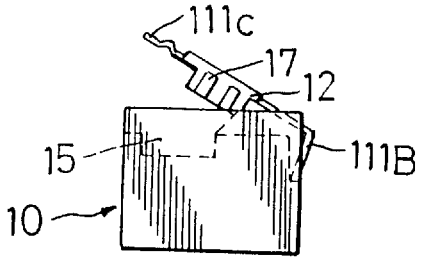
FIG. 6 illustrates how an insulative second housing is folded on an insulative first housing so as to form the rotary switch of this invention.

Referring to FIGS. 5 and 6, the second housing 12 is molded around portions of the protracted intermediate segment 111B in such a manner that the second connecting end portions 111A (see FIG. 4) are bent over the bottom wall 10*b* of the first housing 10 so as to press-fit the second housing 12 in the socket-like cavity 15 of the first housing 10. Under this condition, the connecting end segments 111C extend beyond the upright side wall 10*c* (see FIG. 3) and are parallel to the first connecting end portions 11A (see FIG. 4) for electrical connection, and the protracted intermediate segments 111B are received in the retaining grooves 16 of the first housing 10 so as to position the protracted intermediate segments 111B securely in the grooves 16. Thus, after assembly, the protruded sections of the first and second terminal units 11, 111 (see FIG. 3) are relatively short so that they cannot be easily deformed.

Referring again to FIG. 3, in use, stepwise rotation of the shaft 13 relative to the top wall 10*d* of the first housing 10 actuates a switching action among the first and second contact end portions.

Note that the grooves 16 in the bottom wall 10*b* (see FIG. 3) of the first housing 10 are of a dimension sufficient to permit press-fit engagement with the exposed portions of the protracted intermediate segments 111B. The second housing 12 has two lateral engagement tongues 17 which engage frictionally two opposite side walls of the socket-like cavity 15 of the first housing 10 so as to further strengthen the protracted intermediate segments 111B.

The first and second terminal units can be placed in a mold prior to injection molding so as to be embedded in the first and second housings. Moreover, the first and second housings can be produced by a single mold unit so as to reduce the manufacturing cost.

With this invention thus explained, it is apparent that numerous modifications and variations can be made without departing from the scope and spirit of this invention. It is therefore intended that this invention be limited only as indicated in the appended claims.

I claim:

1. A rotary switch comprising:

an insulative first housing having a top wall with an axial hole formed therein, a bottom wall with a socket-like cavity formed therein, an upright side wall lateral to said top wall, and a shaft journalled in said axial hole to rotate stepwise relative to said top wall;

a plurality of first terminals disposed in a first array, and having first contact end portions embedded in said first housing, and first connecting end portions extending traversely from said axial hole and outwardly of said upright side wall, said first connecting end portions having a first length sufficient for electrical connection;

a plurality of second terminals disposed in a second array, and having second contact end portions embedded in said first housing, and second connecting end portions extending axially from said axial hole and outwardly of said bottom wall at a distal end thereof relative to said upright side wall, each of said second connecting end portions having a second length longer than said first length so as to form a protracted intermediate segment and a connecting end segment for electrical connection, wherein stepwise rotation of said shaft relative to said top wall of said first housing actuates a switching action among said first and second contact end portions; and an insulative second housing molded around portions of said protracted intermediate segments, said second housing having a plug-like body such that, when said second connecting end portions are bent over said bottom wall to extend said connecting end segments parallel to said first connecting end portions and beyond said upright side wall for electrical connection, said plug-like body will be press-fitted in said socket-like cavity.

2. The rotary switch according to claim 1, wherein said bottom wall has a plurality of grooves extending parallel to said first connecting end portions and in communication with said socket-like cavity so as to permit insertion of exposed portions of said protracted intermediate segments therein.

3. The rotary switch according to claim 2, wherein each of said grooves has a size sufficient to permit press-fit engagement with said exposed portion of a respective one of said protracted intermediate segments.

4. The rotary switch according to claim 1, wherein a plane in which said connecting end segments extend outwardly of said bottom wall is substantially the same as a plane in which said first connecting ends extend.

* * * * *